US005360024A

United States Patent [19]

Greig

[11] Patent Number: 5,360,024

[45] Date of Patent: Nov. 1, 1994

[54] RELATING TO POLYMER VISCOSITY AND APPLICATION OF SUCH POLYMERS

[75] Inventor: Colin C. Greig, Redlynch, England

[73] Assignee: British-American Tobacco Company Limited, Middlesex, England

[21] Appl. No.: 885,952

[22] Filed: May 19, 1992

[30] Foreign Application Priority Data

May 23, 1991 [GB] United Kingdom ..... 9111148

[51] Int. Cl.[5] ..... A24B 3/14

[52] U.S. Cl. ..... 131/370; 131/372

[58] Field of Search ..... 131/359, 347, 370, 372

[56] References Cited

U.S. PATENT DOCUMENTS

| | | | |
|---|---|---|---|
| 5,007,440 | 4/1991 | Robinson et al. | 131/359 X |
| 5,060,673 | 10/1991 | Lehman | 131/359 |
| 5,101,839 | 4/1992 | Jakob et al. | 131/364 X |
| 5,105,836 | 4/1992 | Gentry et al. | 131/355 X |

OTHER PUBLICATIONS

*The Condensed Chemical Dictionary,* 10th Edition, 1981, Van Nostrand Reinhold Company, pp. 57, 844, 865, 932.

*Primary Examiner*—Jennifer Bahr

*Attorney, Agent, or Firm*—Kane, Dalsimer, Sullivan, Kurucz, Levy, Eisele and Richard

[57] ABSTRACT

This invention relates to methods of increasing the viscosity of a dispersion containing an alginate by subjecting the dispersion to high shear, such as the shear in a laboratory valve homogeniser. The viscosity of the dispersion increases within the range of two fold to five hundred fold.

The method of increasing viscosity is useful in tobacco reconstitution or tobacco substitut processes, especially where either low levels of binder are required or improved taste characteristics over cellulosic binders, for example, are important.

7 Claims, No Drawings

RELATING TO POLYMER VISCOSITY AND APPLICATION OF SUCH POLYMERS

BACKGROUND OF THE INVENTION

1. Field of the Invention

This invention relates to the viscosity of certain polymers and, in particular, but not exclusively, to the use of such polymers in reconstituted tobacco products or tobacco substitutes.

2. Brief Description of Related Art

In tobacco reconstitution processes it is well known that suitable reconstituted products can be produced without added adhesives provided that the innate pectinaceous material in the tobacco stem is released. This pectin release is achieved by stem 'cooking' at about 100° C. or more for 1–2 hours followed by a further mechanical treatment to yield a material known informally as the stem binder.

However, the product thus produced can be further improved if a small amount, say about 1%, of cellulosic binder material, such as sodium carboxymethyl cellulose, is added. This provides easier processing as well as a stronger final product.

In the case of reconstitution of tobacco sheet by routes other than stem cooking, much higher amounts of non-tobacco binders, usually cellulosic derivatives, are required since no pectin release is involved. The level of binder usage in such products varies, depending on the cellulosic derivative chosen and the required end properties, but is generally within the range of about 5% to about 15%. A disadvantage of such products is the high proportion of binder required, especially if one is seeking to provide an all-tobacco, or substantially so, reconstituted material. Furthermore, the smoke taste characteristics of some binders are often less than desirable. This is particularly the case with sodium carboxymethyl cellulose, (SCMC) for example.

From work which has been undertaken with respect to reconstituted and synthetic products we have identified various alginates, which are cellulose binders derived normally from seaweed sources, which offer satisfactory processability and product strength, but which also have a much more acceptable smoke character than many of the other cellulosics.

Whilst working in the area of all-tobacco reconstituted products, it was found that the stem binder system or mix, which would enable the utilisation of a tobacco derived binder material and very low levels of non-tobacco cellulosics, was only really able to produce sheet material product by conventional flat plate or sheet/band casting methods. Attempts to cast a similar consistency mixture on a horizontal axis rotating drum caster, using a gate coater at the top of the drum, were not successful. Dilution of the slurry to a consistency, and thus viscosity, sufficient to flow under the gate coater when set at the desired height for final product thickness caused the slightly dried, hot slurry to run down the drum. Attempts to cast at a higher consistency also failed since the slurry would not then flow evenly under the gate coater.

Since the gross slurry viscosity for this binder mix was similar to that of other slurries successfully cast on the drum caster, this effect was somewhat surprising. The reason for this is thought to be due to the occurrence of extremely high local viscosity in the areas close to the tobacco and other solid particles, yet low viscosity in the aqueous solution between the particles.

It was then found that beneficial casting effects and a pronounced increase in product strength were obtained by the inclusion of relatively low levels, about 7%, of propylene glycol alginate (PGA) to the slurry. However, in view of the unexpected problems experienced in the drum casting process and our postulated explanation we wished to try and ensure that a truly homogeneous slurry was produced. Rather than use the relatively low shear mixing system as previously utilised, in a purely speculative trial it was decided to run a slurry batch through an APV Gaulin Lab 60 laboratory valve homogeniser at 2000 psi (13600 kPa) to give high shear conditions.

Very surprisingly, it was found that the product slurry exhibited a considerable increase in viscosity over the input material. This viscosity increase allowed very easy and successful casting of an otherwise difficult product. Another particularly beneficial advantage was then identified in that the level of non-tobacco binder required to achieve a desired product strength could be decreased. This benefit can be important in order to keep the level of non-tobacco additives to a minimum.

Further work has identified a number of polymers which exhibit this surprising feature. Physico-chemically, the phenomenon is unusual in that polymers in general react poorly to highshear forces, such as those applied by an homogeniser. Prior teaching and knowledge leads one to expect that the shear work done in the homogeniser is much more likely to break the polymer chains, thus lowering the average molecular weight giving a consequent expected viscosity loss. The identified polymers react contrary to this theory.

SUMMARY OF THE INVENTION

The present invention provides a method of increasing the viscosity of a dispersion comprising an alginate selected from the group of calcium ammonium alginate (CAA), calcium sodium alginate (CSA) and propylene glycol alginate (PGA), the method including the steps of making a dispersion comprising water and one or more of the said group, and subjecting the dispersion to high shear whereby the viscosity of the dispersion is increased at least twofold.

As used herein the term 'fold', usually expressed as 'x-fold', is measured using the following scale; 1.0 denotes no increase, 2.0 denotes a 100% increase, etc.

As used herein the term dispersion is intended to cover a solution, in which alginate is dissolved in water; a suspension, in which alginate, with time, may separate from the suspending medium; and any other slurry-like material, which material may be comprised of a mixture of, for example, alginate molecules in solution and suspension.

It should also be noted that whilst water preferably forms the major proportion of the medium in which the alginate is dispersed, a minor proportion of the medium may be a non-aqueous, organic compound, especially a compound in which the alginate is soluble.

The degree of shear determined by the terms high shear and low shear as used herein can be defined as follows. Low shear is the degree of shear experienced in a mixer, such as a Hobart planetary mixer, the paddle of which revolves at a speed of between one half to four revolutions per second. High shear is the degree of shear experienced in an APV Gaulin Lab 60 laboratory valve homogeniser at pressures greater than about 1000 psi (6800 kPa).

The present invention further provides a dispersion comprising an alginate or pectin, the dispersion having been subjected to high shear and the viscosity of the dispersion having remained substantially the same as, or being greater than, the viscosity of the dispersion before shearing.

Preferably the viscosity of the dispersion has been increased at least two fold, more preferably the viscosity of the dispersion is increased at least three fold, and even more preferably the viscosity may be increased within a range of at least five to five hundred fold, as measured at a particular spindle number and speed.

DETAILED DESCRIPTION OF THE PREFERRED EMBODIMENTS OF THE INVENTION

The alginate may suitably be selected from the group comprising calcium ammonium alginate, calcium sodium alginate, sodium alginate and propylene glycol alginate. These alginates have relevance to the tobacco industry. Other alginates exhibiting this property can be readily determined by simple experimentation following the teaching herein.

The viscosity meter used for all measurements was a Brookfield RVFD digital viscometer, the viscosity being measured at room temperature with various suitable spindles and at various speeds of spindle rotation as detailed in the examples below.

The present invention further provides a tobacco reconstitution or tobacco substitute process comprising the steps of forming a mixture comprised of particulate tobacco material or tobacco substitute material with a binder mixture comprised of water and an alginate selected from the group comprised of calcium ammonium alginate, calcium sodium alginate and propylene glycol alginate, the loading level of the alginate being less than 10% by weight of the water present, homogenising the mixture by subjecting the mixture to high shear to thereby substantially increase the viscosity of the mixture, and casting the mixture, whereby a product of commercially acceptable strength is obtained.

Preferably the strength of the product is sufficient to allow for further processing activity, such as cutting, shredding etc.

Preferably the alginate is present in solution at less than about 5% and more preferably less than about 2.5% by weight.

Preferably the viscosity of the mixture, as measured at a particular spindle number and speed, is increased in the order of at least two fold, and more preferably the viscosity is increased within a range of about five to about twenty fold.

A reconsituted tobacco product or tobacco substitute material produced according to the method of the present invention may comprise alginate within a range of about 2% to about 18% by weight of the dry product.

The present invention even further provides for the use of an alginate or pectin, in a process which, when high shear is applied to the alginate or pectin when in a slurry form, provides an increase in viscosity of the alginate or pectin.

Preferably, the alginate is selected from the group of calcium ammonium alginate, calcium sodium alginate and propylene glycol alginate. Mixtures of the group of alginates may also be utilised.

In processes which involve the use of tobacco materials, the tobacco is suitably finely ground material and may comprise tobacco fines or dust, or ground cut tobacco lamina, stem, or expanded tobacco particles, or combinations thereof. The degree of grinding of the particulate material is dependent on the casting conditions to be used. Enzymatically treated tobacco material may also be utilised with the identified alginates to produce an acceptable reconstituted tobacco product. This represents a further improvement in processes which seek to use enzymatically treated tobacco, which processes have hitherto been limited in extent or otherwise unsuccessful owing to the physical form of the enzymatically treated material.

Processes particularly applicable to the tobacco industry which can make use of aspects of the present invention include conventional flat plate or sheet casting, and drum casting, for example. Extrusion techniques involving high shear may also find application of the present invention. Alternatively, the formulation to be extruded may have been subjected to high shear before being extruded.

The present invention has merits outside the tobacco field, for example, in confectionery manufacture, food processing, drilling muds, i.e. in any situation where the viscosity of the product is of importance and in which conventional levels of binder materials would be beneficially reduced.

The present invention has particular merit in terms of the cost savings which can be made by the reduction in binder loading level required for a desired viscosity. In the alternative, a greater viscosity can be achieved for any desired binder loading level.

In order that the invention may be easily understood and readily carried into effect, reference will now be made to several Examples.

Following the initial discovery that propylene glycol alginate exhibited an increase in solution viscosity, efforts were made to determine whether this effect extended to other cellulosic polymers of use or potential use in the tobacco industry. The materials tested were:

Propylene glycol alginate (Kelcoloid MVF, LVF)
Calcium ammonium alginate (Keltose)
Calcium sodium alginate (Kelset)
Sodium carboxyl methyl cellulose (P800G, P1000G)
Xanthan gum (Keltrol-T)
Pectin (X-66)
Methyl carboxy methyl cellulose C7501
Hydroxy propylcellulose Klucel HF
Sodium alginate (Aldrich, Kelgin LV, Kelgin MV, Kelgin HV, Keltone)

All the alginate materials, except the sodium alginate supplied by Aldrich Chemicals, and the xanthan gum were produced by Kelco International Limited. Other materials were obtained from Courtaulds Chemicals (SCMC), Unipectine S.A. (X-66), Henkel (C7501) and Aqualon (Klucel).

All of the Kel-prefixed names are registered trade marks.

Each polymer was made up into a solution with mains water at the level indicated in Table 1 and allowed to stand after initial mixing in a Hobart planetary mixer until solution was completed. Volumes of 5–10 litres were used to allow homogenisation of at least 1 litre samples at each of the pressures listed below. The first three litres of each volume was rejected before sampling. The viscosity of each 1 litre sample was measured thus:

a) 'Raw' solution.
b) Solution pumped through homogeniser but with no added shear applied by the homogenising valve.
c) Homogenised at 1000 psi (6800 kPa)
d) Homogenised at 2000 psi (13600 kPa)
e) Homogenised at 3000 psi (2040 kPa)
f) Homogenised at 4000 psi (27200 kPa)
g) Recirculated. In some cases samples were recirculated through the homogeniser for several passes to determine the effect of multiple treatments.

The results of these treatments are given in Table 1.

TABLE 1

| | | | | Solution | Maximum Increase Viscosity Increase (fold*) | Maximum Increase Pressure (psi) | Time Stability Viscosity Increase (fold*) | Time Stability Time (days) |
|---|---|---|---|---|---|---|---|---|
| A. | i) | Kelcoloid | HVF | 1% | 5.9 | 1000 | 4.3 | +1 |
| | | (PGA's) | HVF | 0.5% | 14.7 | 1000 | — | — |
| | ii) | | LVF | 1% | 12.4 | 2000 | 13.4 | +3 |
| B. | i) | Keltose | | 1% | 10.6 | 2000 | 10.5 | +1 |
| | | (CAA) | | 0.5% | 415.0 | 3000 | 475 | +1 |
| C. | i) | Kelset | | 1% | 13.6 | 3000 | 32.5 | +4 |
| | | (CSA) | | | | | | |
| D. | i) | P 800G | | 1% | 0.23 | 1000 | 0.23 | +1 |
| | ii) | P 1000G | | 1% | 1.21 | 4000 | 1.21 | +4 |
| | | (SCMC's) | | | | | | |
| E. | | Keltrol-T | | 1% | 0.72 | 1000 | — | — |
| | | (Xanthan gum) | | | | | | |
| F. | | Unipectine X-66 | | 2% | 2.7 | 2000 | — | — |
| | | (Pectin) | | | | | | |
| G. | | C7501 | | 1% | 0.95 | 1000 | 0.81 | +1 |
| | | (Methyl carboxy-methyl cellulose) | | | | | | |
| H. | | Klucel HF | | 1% | 0.5 | 1000 | 0.5 | +1 |
| | | (Hydroxypropyl cellulose) | | | | | | |
| I. | | Aldrich | | 1% | 1.10 | 3000 | 0.83 | +1 |
| | | Kelgin LV | | 1% | 0.92 | 1000 | — | — |
| | | Kelgin MV | | 1% | 0.96 | 1000 | — | — |
| | | Kelgin HV | | 1% | 1.23 | 1000 | — | — |
| | | Keltone | | 1% | 0.92 | | | |
| | | (all sodium alginates) | | | | | | |
| | | [Mean of 5 samples | | | 1.03] | | | |

*Denotes increase measured as "X-fold" i.e. 1.0 denotes no increase, 2.0 100% increase etc.

The table shows quite clearly that materials A, B and C give considerable viscosity increases on homogenisation, Material F gives a moderate increase in viscosity. The viscosity of Materials I and D (ii) remain substantially unchanged despite the high shear applied. Materials D (i), E, and H exhibit viscosity decreases as one would predict by teaching and precedent. Material G exhibits a mild viscosity decrease resulting from the shear conditions applied.

As mentioned above, polymer rheology is a complex subject but some general trends exist. First, viscosity normally increases (at equal concentration) with increased molecular weight, and viscosity usually varies uniformly with degree of substitution (it may rise or fall). The available molecular weight and degree of substitution data for the materials in the table do not allow ready 'connections' to these trends.

The behaviour of the materials D(i), E and H of Table 1 is that expected from prior knowledge, the explanation being that the shear work done in the homogeniser is sufficient to break the polymer chains, thus lowering the average molecular weight (and changing the molecular weight distribution) with the consequent expected viscosity loss.

This explanation is that conventionally given for long chain 'rod-like' polymers such as the wood cellulose derived materials exemplified. It would seem that the alginates as a class do not fall into this category, hence their unexpected behaviour.

Following identification of suitable polymers for the tobacco industry, the following examples were undertaken.

EXAMPLE 1

2kg of shredded tobacco blend was extracted with 6 litres of water overnight. This mixture was then added to a binder mixture prepared as follows:

160 gms of propylene glycol alginate (KELCOLOID HVF, Kelco) were added with vigorous agitation but low shear to 6 litres of water in 3×2 litre portions. This solution was combined with the tobacco mixture and stirred in a planetary mixer for 1.5 hours to give a clear, lump-free paste.

The viscosity of the mixture pre-homogenisation was measured by a Brookfield RVFD digital viscometer at 2, 4, 10 and 20 rpm using spindle number 5 as follows:

| Speed | Viscosity (CP) |
|---|---|
| 2 | 45,500 |
| 4 | 30,800 |
| 10 | 17,480 |
| 20 | 11,120 |

The combined tobacco and binder mixture was then homogenised by one pass through an APV Lab 60 homogeniser at 2000 psi (13600 kPa) to give a final volume, including wash waters, of 18 litres.

15 litres of homogenised mixture were removed and mixed with 100 g of glycerol in 2 litres of water using a planetary mixer. The viscosity of this mixture was measured as above with the following results:

| Speed | Viscosity (CP) |
|---|---|
| 2 | 79,200 |
| 4 | 48,600 |
| 10 | 24,760 |
| 20 | 14,800 |

The viscosity increase due to homogenisation, despite dilution, is as follows:

| Speed | | |
|---|---|---|
| 2 | 1.74 fold | average 1.51 fold |
| 4 | 1.58 fold | |
| 10 | 1.41 fold | |
| 20 | 1.33 fold | |

The final mixture was easily cast onto a drum caster at a gate height of 0.8 mm to give a product which could be shredded after conditioning and then made into cigarettes.

The alginate was present as a 0.7% solution in the final slurry product at casting.

EXAMPLE 2

1 kg of shredded tobacco was enzymically treated overnight in 6 litres of water. The resulting slurry was homogenised by one pass through the homogeniser at 1000 psi (6800 kPa) to reduce the particle size and the product was then transferred to a planetary mixer. 80 gms of propylene glycol alginate were pre-dispersed in 3 litres of water in a vortex mixer and added to the homogenised tobacco slurry. The mixture was stirred in the planetary mixer for 1 hour and a further 40 gms of dry propylene glycol alginate powder were added portion wise, followed by 30 minutes stirring. The viscosity of this mixture was measured with the results as follows using spindle number 2:

| Speed | Viscosity (CP) |
|---|---|
| 2 | 7,540 |
| 4 | 4,270 |
| 10 | 2,088 |
| 20 | 1,212 |

Although this mixture could be cast on the drum caster, very close attention to coating height was required to achieve even product thickness and the final material was unsuitable for further treatment.

Accordingly the mixture was then homogenised by one pass at 2000 psi (13600 kPa). 69 gms glycerol was added and the mixture again stirred for 5 minutes to disperse the glycerol.

The viscosity of this final mixture was as follows using Spindle number 6.

| Speed | Viscosity (CP) |
|---|---|
| 2 | 47,500 |
| 4 | 27,000 |
| 10 | 13,000 |
| 20 | 8,150 |

The viscosity increase, due to homogenisation but without dilution, is:

| Speed | | |
|---|---|---|
| 2 | 6.30 fold | average 6.39 fold |
| 4 | 6.32 fold | |
| 10 | 6.22 fold | |
| 20 | 6.72 fold | |

The mixture could now be cast at 0.6 mm gate height to give a product which, after conditioning, could be shredded easily and made into cigarettes.

The alginate was present as a 1.2% solution in the final slurry product.

It should be noted that prior work had shown that treatment of cut tobacco with enzymes caused such severe loss of physical form that cigarettes could not be made from the resulting slurry-like product.

The above example demonstrates that the present invention permits the processing of a material that was otherwise difficult or impossible to process.

EXAMPLE 3

Alginate may also be utilised in conjunction with stem binder. 16.8 g of propylene glycol alginate was present in 5 litres of water containing 700 g total solids. The solids also comprised tobacco (water treated stem), a mixture of homogenised stem binder and neutralised ammonia, perlite, glycerol and extracted flavourings. The alginate was present as a 0.34% solution in the final slurry product. The viscosity of the mixture before homogenisation using spindle number 5 at a speed of 4 r.p.m. was 19,000 centipoise. The viscosity of the mixture after homogenisation and under the same spindle conditions was 22,000 centipoise. The alginate content on a dry weight basis of the final product was 2.4%. The remainder of the binder comprised 12.1% stem binder/ammonia mixture.

In the tobacco-containing products made, alginate was present within a range of about 5.8%–16.6% by weight of the final dry weight of the product. Where alginate was utilised with a stem binder, the percentage by weight of the dry product could be as little as about 5.0%, and could be about 2.4%. Overall, alginate may be present in the final dry product within a range of about 2% to about 18% by weight. Alginates selected according to the present invention allow for acceptable viscosity during processing conditions, a low percentage of binder by weight of the final dry product and acceptable smoke taste, even at higher loading levels of alginate. There are thus considerable advantages to be gained by use of the present invention.

The viscosity increases obtained with high shear are stable with time over periods of a day or more, as indicated in Table 1. This duration of viscosity stability is sufficient to enable processing to occur without immediate viscosity loss.

The viscosity measurements made herein were carried out at an ambient laboratory temperature of about 15° C.

The viscosity increase exhibited by the pectin solution is at least a two-fold increase. However, the actual viscosity measurement after shearing is, in absolute terms, fairly low, e.g. 110 centipoise at a pressure of 2000 psi (13600 kPa), in comparison with the viscosities exhibited by alginates A, B and C of Table 1.

I claim:

1. A process which comprises; forming a mixture comprised of particulate tobacco material or tobacco substitute material with a binder mixture comprised of water and an alginate selected from the group consisting of calcium ammonium alginate, calcium sodium alginate and propylene glycol alginate, the loading level of the alginate being less than 10% by weight of the water present; homogenising the mixture by subjecting the mixture to high shear at pressures greater than about 1000 psi to thereby substantially increase the viscosity of the mixture; and casting the mixture; whereby a reconstituted tobacco product or tobacco substitute is obtained.

2. A process according to claim 1 wherein the alginate is present in solution at less than about 5% by weight.

3. A process according to claim 3, wherein the alginate is present in solution at less than about 2.5% by weight.

4. A process according to claim 1, wherein the viscosity of the mixture is increased in the order of at least two fold.

5. A tobacco reconstitution or tobacco substitute process according to claim 4, wherein the viscosity of the mixture is increased within a range of about five to about twenty fold.

6. A reconstituted tobacco product or tobacco substitute produced according to the process of claim 1, wherein said alginate is present in the range of about 2% to about 18% by weight of the dry product.

7. A reconstituted tobacco product or tobacco substitute according to claim 6, wherein said alginate is present within the range of 5.8% to 16.6% by weight of the dry product.

* * * * *